US005893467A

United States Patent [19]

Burchell

[11] Patent Number: 5,893,467

[45] Date of Patent: Apr. 13, 1999

[54] APPARATUS FOR MANAGING PRODUCTS DISPLAYED ON PEGS

[76] Inventor: James R. Burchell, 318 New York Ave., Clairton, Pa. 15025

[21] Appl. No.: 08/813,533

[22] Filed: Mar. 7, 1997

[51] Int. Cl.[6] ..... A47F 5/00

[52] U.S. Cl. ..... 211/54.1; 211/51; 211/57.1

[58] Field of Search ..... 211/54.1, 59.1, 211/57.1, 51, 183, 59.3, 106; 312/71

[56] References Cited

U.S. PATENT DOCUMENTS 5,641,077 6/1997 Tufano et al. ..... 211/54.1

*Primary Examiner*—Robert W. Gibson, Jr.
*Attorney, Agent, or Firm*—James R. Burchell

[57] ABSTRACT

An apparatus for managing products displayed on pegs is provided. A puller member having an elongated body substantially as long as the peg on which is installed also has a downturned front gripping portion and a rear downward extending backstop. A detachable stabilizer portion may additionally be provided on the top of the elongated body. The stabilizer rests on a peg support member to stabilize the puller member against rotation. The backstop has an aperture therein for slidably receiving a peg. A groove can be provided on a lower surface of the elongated body along with an indentation near the downturned front portion wherein a peg head may seat when there are no products remaining on the peg. The puller member can also have a free-floating backplate disposed on the peg between the backstop and the products. As the backstop advances the free-floating plate and products forwards the free-floating plate remains behind the products when the puller is pushed back. The free-floating backstop can also act as a stabilizer for the elongated body. The free-floating backplate can be extra wide and have an additional aperture therein to receive an adjacent peg to simultaneously advance an adjacent row of products. The puller member may also have a product identification plate removably attached to the downturned front portion. Additionally, a return mechanism may be attached to puller member to automatically retract the puller member when pulled forwards and released.

25 Claims, 17 Drawing Sheets

APPARATUS FOR MANAGING PRODUCTS DISPLAYED ON PEGS

FIELD OF THE INVENTION

The invention relates to a system for managing rows of products displayed on pegs and for advancing those products in rows towards the front of the pegs. More particularly, the invention is directed to a puller member which can be installed on a peg and which can advance a row of products stored on the peg towards the front of the peg when the puller member is drawn forwards.

BACKGROUND

In retail stores, particularly but not exclusively grocery stores, products are displayed on pegs for customer inspection and selection. It is essential that the pegs and the products displayed thereon be organized in order to maximize the use of space and maintain an on-hand inventory. Furthermore, as products are sold it is necessary to regularly move the products towards the front of the peg so that customers can inspect the products and select those they desire to purchase. If the product is hidden towards the back of the peg, or if product is disorganized and displayed chaotically or unattractively, then potential sales may be lost. The spacing of the pegs is influenced not only by the dimensions of the product displayed thereon but additionally by the need to regularly move rows of products towards the front of the peg. In the usual case, the rows of products are moved towards the front of the pegs by hand. This requires a certain minimum amount of spacing between rows and columns of products in order to allow a store clerk to get at least one hand in-between the products and move the row forwards. As a result of this, less linear space is available to display the products.

U.S. Pat. No. 5,222,608 to Eklof et al., U.S. Pat. No. 5,114,021 to Fredrickson, and U.S. Pat. No. 4,821,894 to Dechirot all disclose devices for peg system display racks which can automatically advance a row of products towards the front of the peg as the products are removed by customers. Each of the references disclose systems which utilize a spring to bias a pusher member into contact with the products to push the row of products towards the front of the peg. The spring provides a generally constant forward pressure on the pusher member which keeps the products urged toward the end of the peg. As a product is removed from the peg the row is automatically advanced forward to the bent portion of the peg. In each system, an outward tip portion of the peg normally must be bent substantially upwards to prevent the products from being pushed off of the peg by the spring.

The standard pegs widely used in stores has a short portion of the very end of the tip which is bent upwards slightly at about a 45 degree angle. Devices like those disclosed in Eklof, Fredrickson, and Dechirot require that the tip portion of the peg be bent about 90 degrees to ensure that the products are not pushed off. Pegs which have tip portions angled so steeply can present difficulties in loading and unloading products onto the peg as wells as requiring more time for rotating and facing the products. The most popular types of pegs have a tip portion which is angled upward only slightly, such as about 45 degrees, and just enough to keep products from falling off and still permit quicker loading, rotating, and facing of the products. Since most stores use these types of pegs, devices like those disclosed in Eklof, Fredrickson, and Dechirot can require replacement or modification of a substantial number of pegs.

Thus, such automatic product advancing devices have not been widely accepted in the marketplace.

The spring and the pusher members can take up space behind the product which could otherwise be used to hold more merchandise on the peg. If the spring is too short, it will not be able to push the last product to the front of the peg. If the spring is too long, it takes too much space on the peg that could otherwise be used for storing products. Also, springs and pusher members are relatively small pieces which can easily be lost or damaged, especially when installing dozens, even hundreds, of these parts on a single peg type display rack, and there may be several such peg display systems in each store.

Such systems may require more installation time to attach the springs and pusher members to each other and to attach the spring to the back of the display. Correspondingly, there are more pieces which can wear out and need replaced. For example, the spring may become bent or stretched and the pusher member may break, or become cracked, especially if the particular unit is installed in a refrigerated display. Multiple small pieces typically result in higher repair and replacement costs. Each of these systems normally requires that the tip of the peg have some substantially upturned portion in order to keep the products from being pushed off of the peg by the spring. In fact, exploit these systems fully, it might even be advisable that a particular type of pegs, such as having an upturned tip portion, and display rack be used.

In systems like these, the pusher member can potentially stick or become jammed on the peg. There is the problem that foreign objects such as dirt, sticky or frozen liquids, or pieces of products could become jammed between the pusher member and the peg thereby preventing a device from pushing the products towards the front of the peg. Particularly in cases with items hung on a peg, there is often a small perforated portion around the hole that the peg goes through. In such packaging, when the products are inserted on the pegs, the peg can simply be pushed against the perforated part so that the perforated part can break out upon installing the products on the peg. This small piece, usually plastic or paper, might easily become wedged between the pusher member and the peg thereby jamming the system.

As a result of the potential problems which can be associated with such automatic product advancing devices, in addition to the necessity that the pegs have substantially upturned tips, they have not been widely accepted.

In regard to systems for managing products displayed on shelves, U.S. Pat. Nos. 5,413,229 and 5,469,976 disclose systems for managing rows of products displayed on shelves, for moving those rows of products towards the front of the shelf, and for reloading the shelves with products. Those systems include a plurality of adjacent side rail assemblies positioned along the shelf extending from front to back, a plurality of puller members for pulling the products to the front of the shelf, and a loader for reloading rows of products. Each side rail assembly includes a base rail and a divider attached to the base rail, wherein at least one row of products may be positioned between the dividers of adjacent side rail assemblies. An unbiased backstop assembly is positioned between dividers of adjacent side rail assemblies, wherein the backstop assembly is movable between the front and back of the shelf and is adapted to advance at least one row of products toward the front of the shelf. A puller member positioned between the dividers of adjacent side rail assemblies is associated with the backstop assembly. The puller member is manually moved forwards to advance the backstop assembly, and the row of products, towards the front of the shelf, but to leave the backstop assembly undisturbed when the puller member is pushed towards the rear of the shelf. However, this type of system is not suitable for a peg type product display.

Therefore, there is a need for a system for allocating and managing space among products displayed on pegs which overcomes the aforementioned problems. Such a system is needed to maximize the available display space and to move quickly and easily advance rows of products towards the front of the pegs so that customers can inspect the products and select those they desire to purchase. The system can also facilitate faster stocking, rotating, and facing of the products by store personnel. Additionally, the system should not require replacement or significant modification of existing peg type display racks. This is accomplished by providing a cost-effective system for allocating and managing space among products displayed on pegs. The system should be simple to manufacture, inexpensive to purchase, quick and easy to install, adaptable to a wide variety peg hangers with little or no modifications to the existing peg display, and facilitate stocking, rotating and facing, i.e. advancing products towards the front of the pegs for customer inspection and selection.

SUMMARY

The present invention is directed toward an device for allocating and managing space among products displayed on pegs. Installing a number of these devices can satisfy the need to maximize available display space and at the same time can provide a means for efficiently stocking, rotating, and advancing rows of products towards the front of the peg. The device is easily manufactured, inexpensive to purchase, and requires little or no modification to existing peg display systems. Labor costs can be reduced because employees can more quickly stock, rotate, and face the products.

A system for managing products displayed on pegs having features of the present invention employs multiple puller members. Typically, a single puller member can be positioned on a single peg to advance rows of products on that particular peg. However, the puller member can be adapted to be installed on commonly used double-peg type hangers. Each puller member can have a flat, elongated body which is slightly longer than the peg on which it is positioned, a front gripping end, and a downward extending backstop at the back end.

The preferably flat body can additionally provide a surface which aids in the dispersion of cool air in refrigerated displays. Typical refrigerated peg type displays blow cold air out through openings in the back of the display. In refrigerated peg displays such as this the cool air generally only disperses a small amount outwards from the openings in the back of the display and then sinks downwards into the base of the display. A number of flat puller members installed on pegs in such a display provide a plurality of flat surfaces which carry the cool air outwards towards the end of the peg along the flat body of the puller before the cool air can begin sinking downwards. As a result, the products towards the ends of the pegs are better cooled.

To advance products toward the end of the peg, the gripping end is pulled forwards. As the puller member moves forwards the downward extending backstop engages the backmost product and thereby advances the entire row towards the front of the peg. After the products are moved to the front of the peg the puller member is pushed backwards leaving the products undisturbed.

The puller member can also be provided with a free-floating backplate which can be inserted on the peg between the products and the downward extending backstop. Thus, the backstop moves the free-floating backplate forwards as the puller member is drawn forwards but leaves the free-floating backplate behind the products when the puller member is pushed back. The free-floating backplate can be made wider that the elongated body to act as a stabilizer to inhibit the puller member from rocking from side to side.

Alternatively, or additionally, a detachable stabilizing portion can be provided on top of the elongated body which extends past the downward extending backstop. The stabilizer can be sized and adapted to rest on a peg support member at the back of the peg display to steady the puller member and inhibit side to side rocking movements. The detachable stabilizer preferably can have an upwardly angled portion at the rear most edge to guide the stabilizer up over the peg support member without becoming caught on the edge of the peg support member.

To further stabilize the puller member against rocking motion when the peg is empty an indentation on the underside of the elongated body, near the front gripping end, can also be provided to nestle the tip of the peg. Additionally, an appropriately sized groove may be provided on the underside of the elongated body, the edges of which help to guide the tip of the peg into the indentation.

In some embodiments, the elongated body can be made from two slidingly adjustable pieces so that the puller member is adjustable to accommodate pegs of different lengths.

Other embodiments of the puller member can include a detachable face plate connected to the front gripping end, a wide backplate member which can be either free floating or attached the downward extending backstop, and a puller return mechanism.

The detachable face plate can be made in different sizes to accommodate different sized product price/identification tags. The detachable face plate can be used as a gripper to draw the puller member forwards.

The wide backplate is sized and positioned to advance either an additional row of products displayed on an adjacent peg or a wider product which is displayed on two adjacent pegs. The wide backplate can either be attached to the downward extending backstop or can be free-floating on the pegs in between the products and the downward extending backstop. As a free-floating backplate, the wide backplate can have the same stabilizing advantages as the free-floating backplate described previously.

The return mechanism can be a spring, or other means, which can be attached, for example, to the stabilizer portion of the puller member. At the other end, the return spring can be attached to the peg support member, the back of the peg display, or in some other manner, such that when the puller member is pulled forwards the return mechanism draws it back when it is released.

Other details, objects, and advantages of the present invention will become apparent from the following description of certain embodiments illustrated in the drawings.

BRIEF DESCRIPTION OF THE DRAWING FIGURES

DETAILED DESCRIPTION OF CERTAIN EMBODIMENTS

Figure 1:
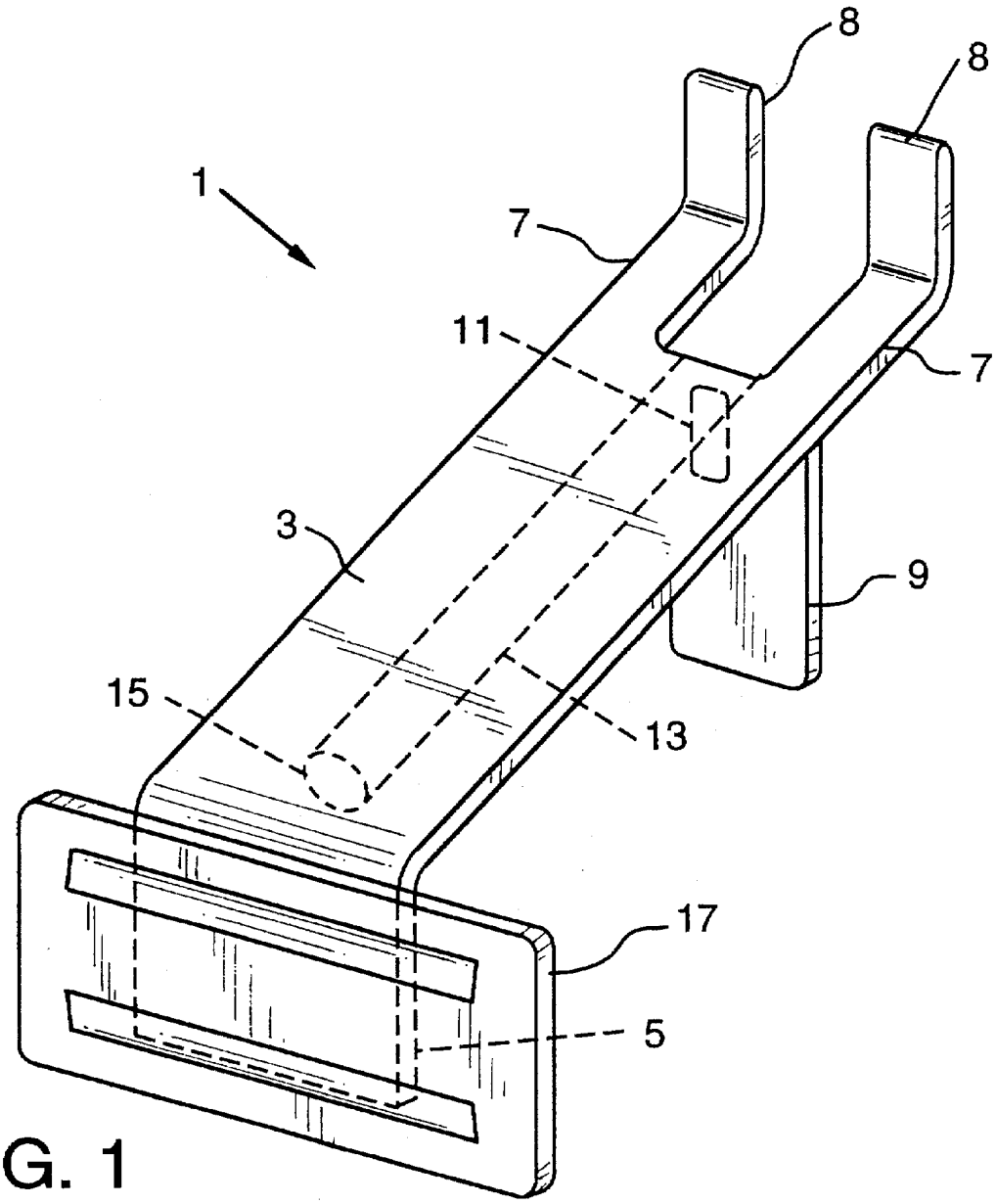
FIG. 1 is a perspective view of an embodiment of a single peg puller member.
Figure 2:
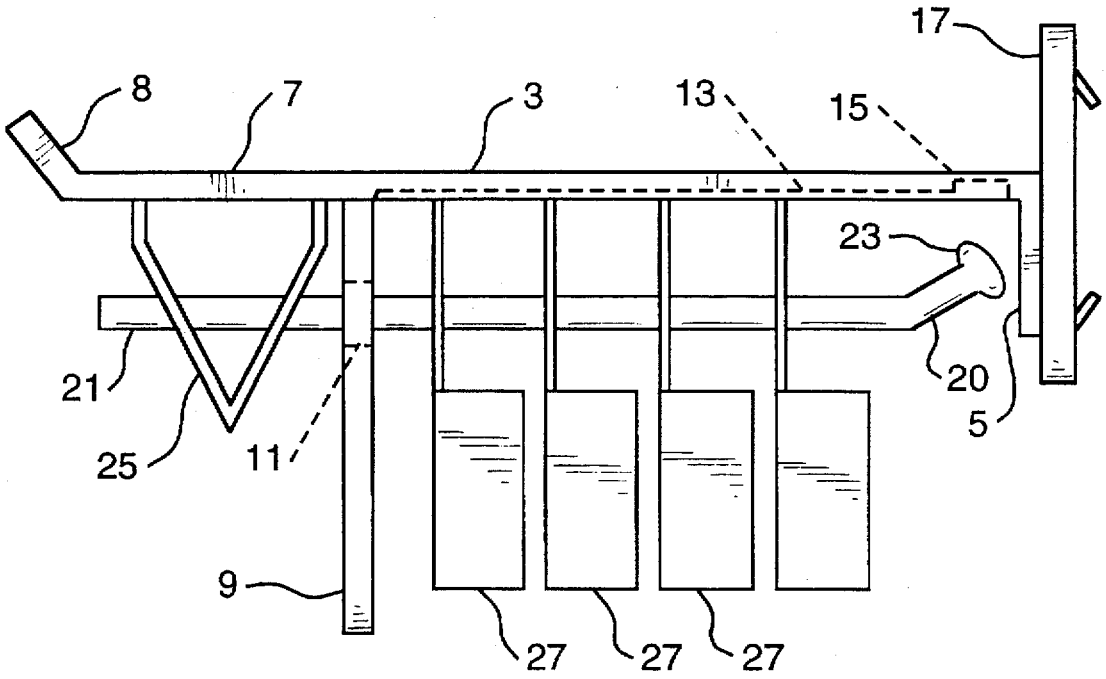
FIG. 2 is a side view of the puller member shown in FIG. 1.
Figure 3:
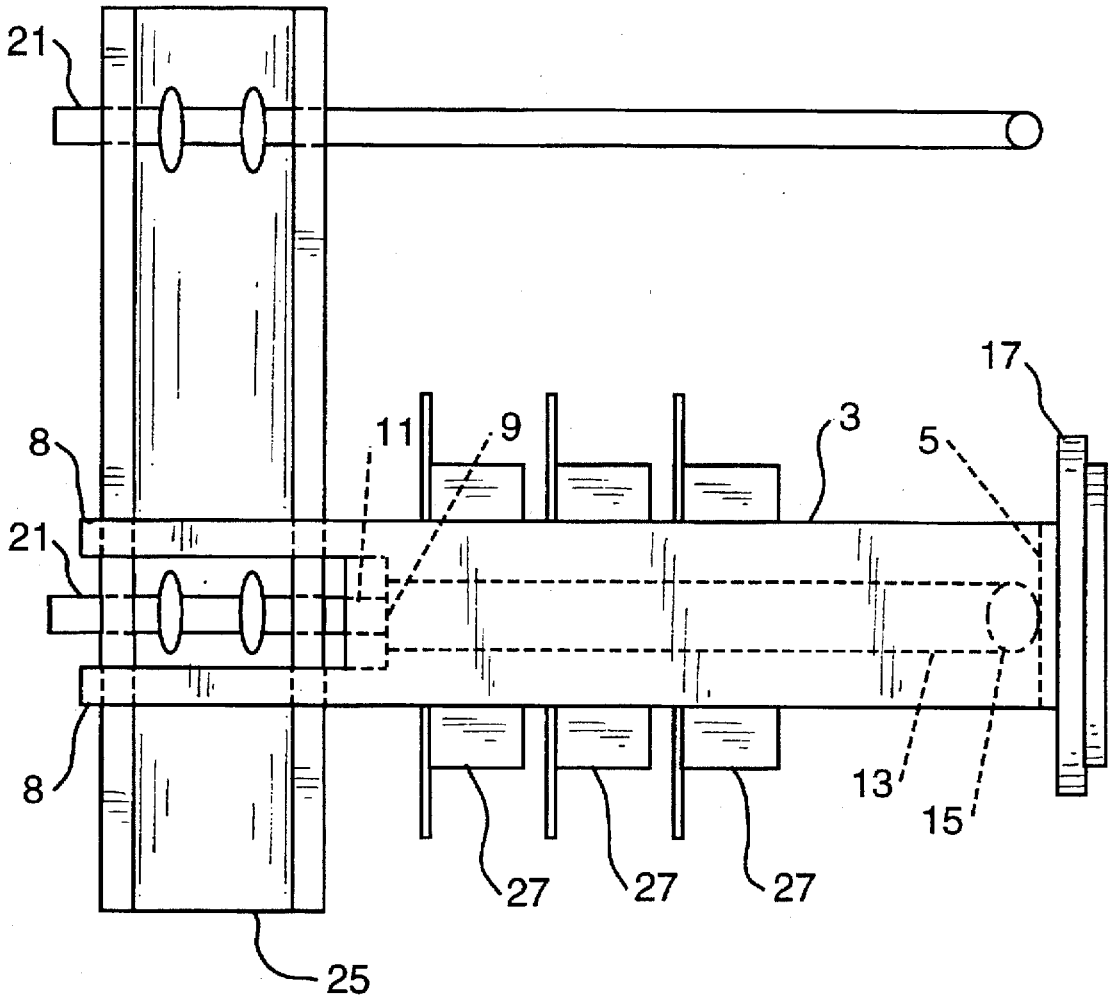
FIG. 3 is a top view of the puller member shown in FIG. 1.

Referring now to the drawing figures wherein like elements are numbered the same in the several drawings, FIGS. 1 through 3 illustrate a device having features of a present embodiment of the invention. A puller member 1 has a preferably flat elongated body 3 with a downturned front portion 5, a downward extending backstop portion 9, two extending stabilizer portions 7 and angled tail portions 8. The angled tail portions help to guide the stabilizer over a peg support member. An aperture 11, which may be a hole or a slot, is provided in the backstop portion 9 for slidably engaging a peg 21. The puller member 1 is preferably slightly longer than the peg 21 on which it is installed. The underside of the elongated body 3 may be provided with a wide groove 13 and an indentation 15. When there are no products 27 on the peg 21 the peg head 23 can nestle in the indentation 15. The wide groove 13 can act to guide the peg head 23 into the indentation 15. A removable face plate 17 can be attached to the downturned front portion 5. The detachable face plate can be made in various sizes to accommodate different sized product price/identification tags. In FIG. 2, the puller member 1 is illustrated installed on the peg 21 with products 27 disposed on the peg 21 in front of the backstop 9. The peg 21 is mounted in a V-shaped peg support member 25 (which is part of the peg display unit) with a slightly angled tip portion 20 and a peg head 23. The stabilizing portion 7 rests on top of the peg support member 25 and stabilizes the puller member 1 from turning to either side. The puller member 1 is shown with the peg 21 inserted through the aperture 11 in the downward extending backstop 9. After a puller member 1 is inserted onto a peg 21, products 27 are loaded onto the peg 20 and pushed back against the backstop 9. As products 27 are removed from the peg 21 by customers, store personnel may periodically pull on either the downturned portion 5 or the detachable face plate 17 to draw the backstop 9 into contact with the back of the last product 27 in the row and advance the remaining products 27 towards the front of the peg 21. Afterwards, the puller member 1 is returned to the original position against the peg holding member 25.

Figure 4:
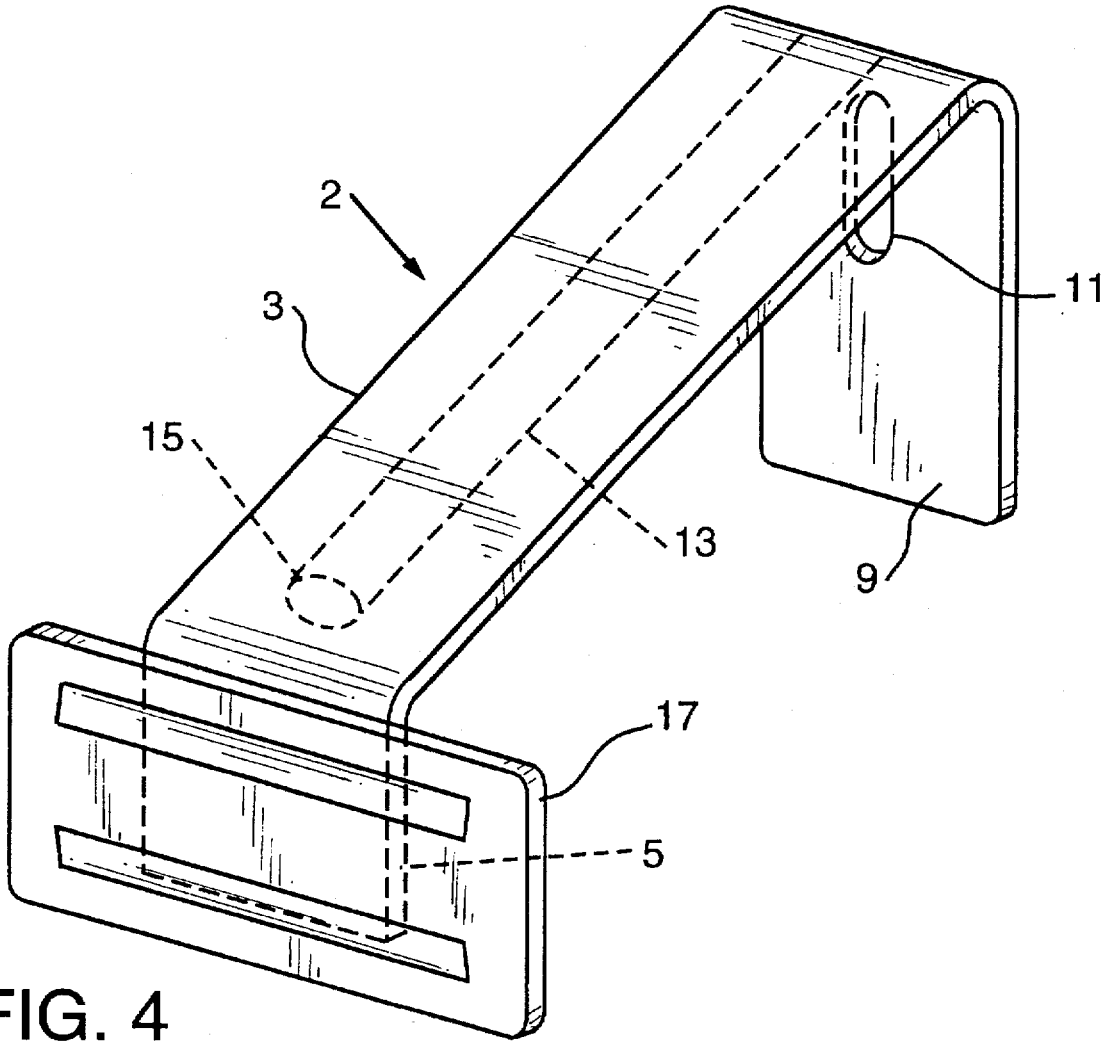
FIG. 4 is a perspective view of an alternative embodiment of a puller member.
Figure 5:
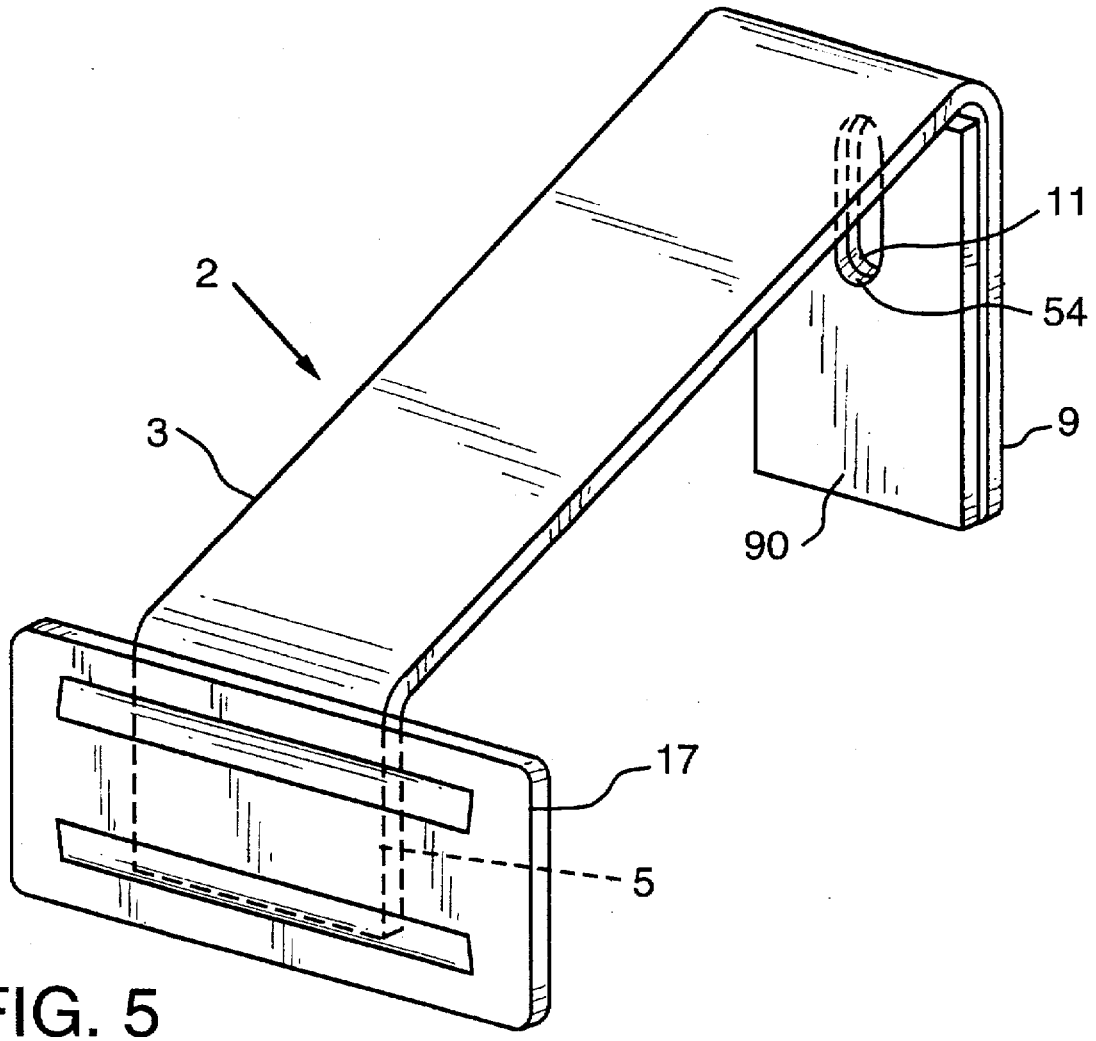
FIG. 5 is a perspective view of another alternative embodiment of a puller member.

In FIG. 4, an alternative embodiment of a puller member 2 is illustrated. In this embodiment, no stabilizer portion is provided. This embodiment is installed where the pegs 21 are held in holes in a peg board and there is no peg support member 25 on which the stabilizer portion 7 may rest. Alternatively, as shown in FIG. 5, the puller member 2 can be provided with a free-floating backplate 90 having an aperture 54 coaxial to the aperture 11 of the downward extending backstop 9. In this embodiment, the indentation 15 and the groove 13 are not provided because the elongated body 3 rides on the free-floating backplate 90 even when there are no products 27 on the peg 21. The puller member 2 further need no stabilizer 8 because the top edge of the free-floating backplate 90 stabilizes the puller member 2. However, the free-floating plate 90 can be used even if the elongated body 3 is provided with a groove 13 and indentation 15. Additionally, the free-floating backplate 90 can be used in conjunction with any of the previously, or hereinafter, described embodiments of the puller member.

Figure 6:
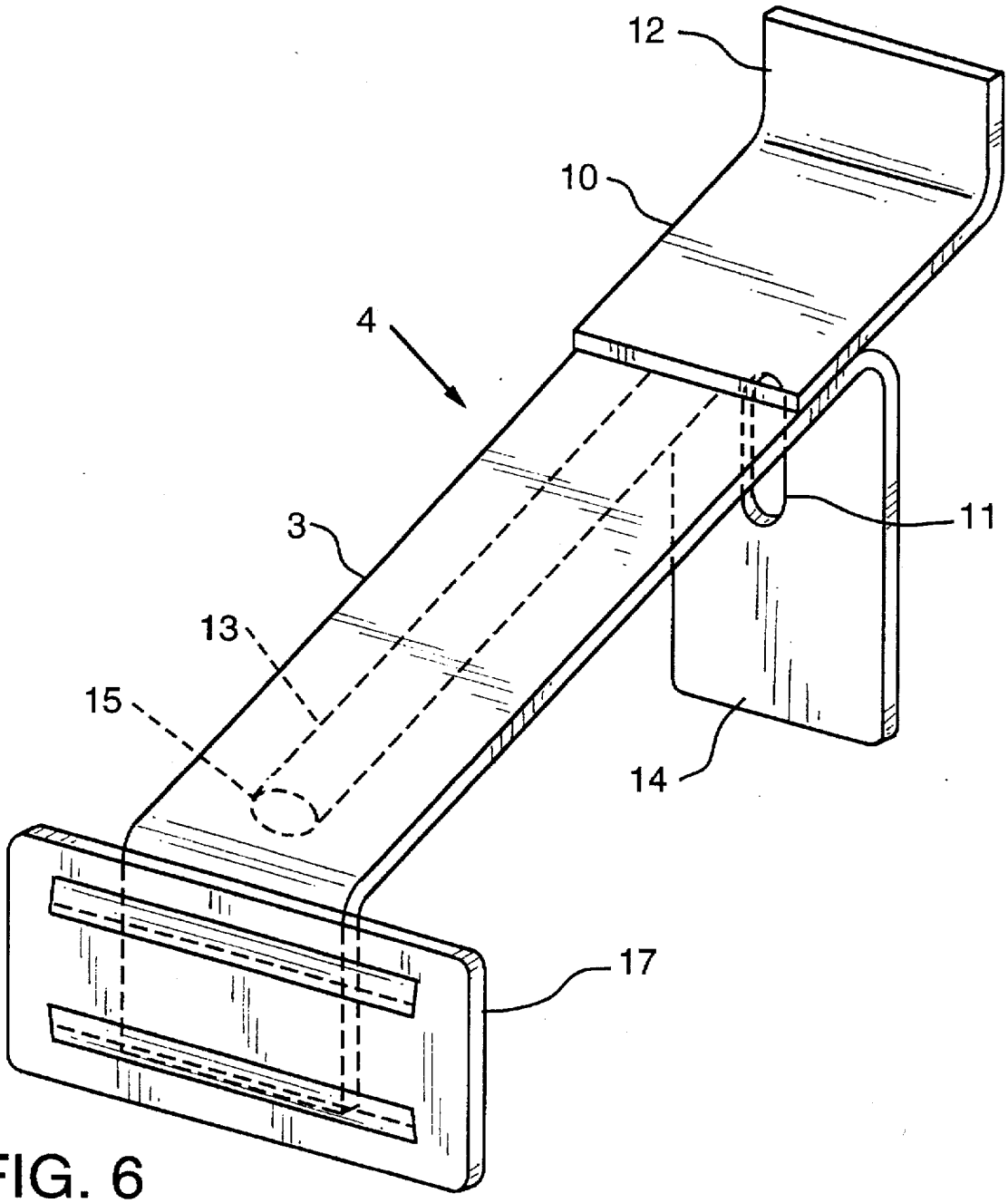
FIG. 6 is a perspective view of another alternative embodiment of a puller member.

In another alternative embodiment, shown in FIG. 6, a puller member 4, having the same elongated flat body 3 and front downturned portion 5, additionally has a detachable stabilizer 10 attached to the rear portion. The stabilizer can also be provided with a slightly angled edge 12 to guide the stabilizer 10 over a peg support member. In this embodiment the downturned portion 14 and the detachable stabilizer 10 are not integrally formed. This puller member 4 is very adaptable since the puller member 4 may be utilized in displays where a stabilizer will not work or, if needed, the detachable stabilizer 10 can be attached. The downturned portion 10 has an aperture 11 for the peg 21 and can have the wide groove 13 on the underside of the elongated body 3 to guide the peg head 23 into the indentation 15. The puller member 4 can also be provided with a detachable face plate 17 attached to the downturned portion 5.

Figure 7:
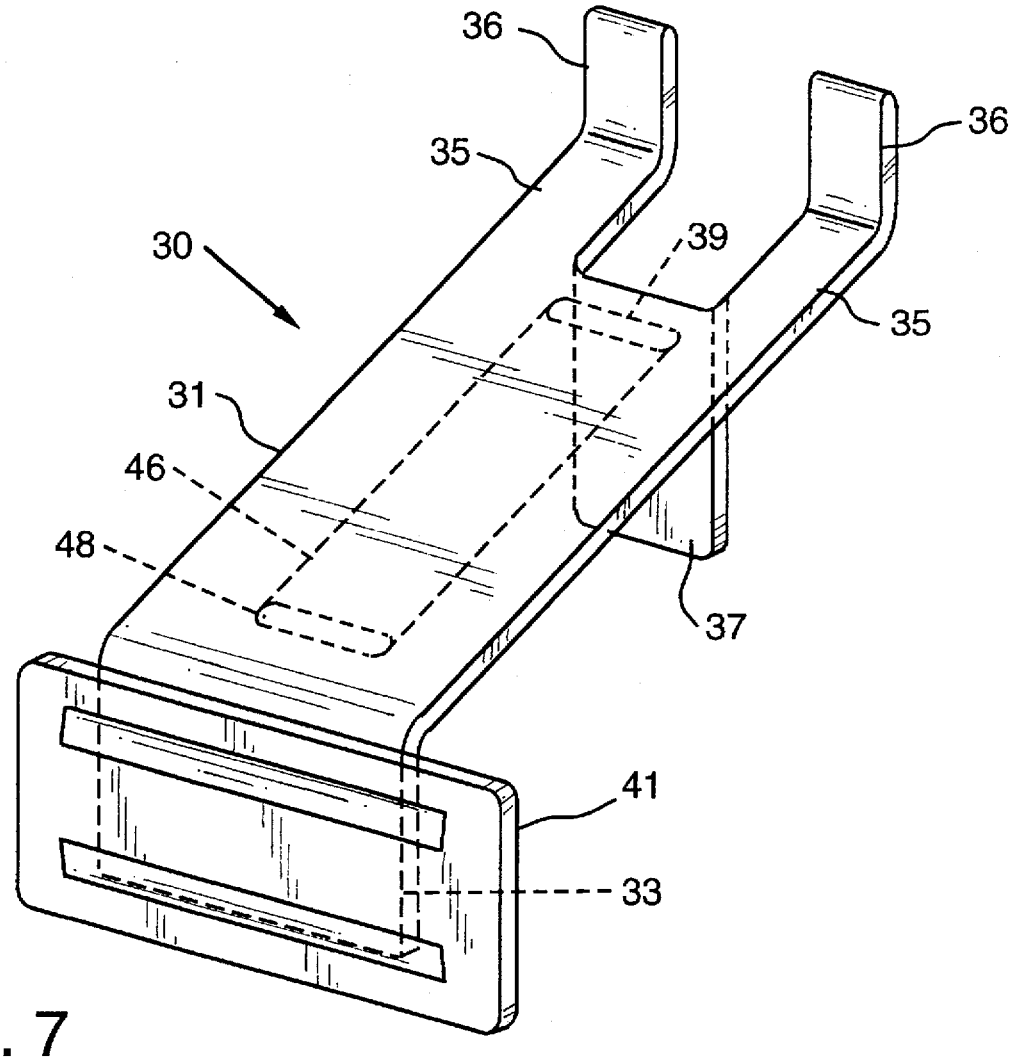
FIG. 7 is a perspective view of an embodiment of a double peg puller member.

An embodiment of a puller member for use with a double peg system is illustrated in FIG. 7. The puller member 30 has a preferably wide, flat, elongated body 31 with front downturned portion 33, integral rear stabilizer 35, and downward extending backstop 37. The rear stabilizer 35 can also have a slightly angled tail portion 36 to guide the stabilizer 10 over a peg support member. A wide indentation 48 is also provided on the underside of the elongated body 31 for nestling the wide double-peg head 52. Extra wide groove 46 can be provided on the underside of the elongated body to guide the double-peg head 52 into the wide indentation 48. An elongated horizontal aperture 39 is sized wide enough for two pegs of a dual peg type product hanger 51 to slide through. A wide groove 46 can also be provided on the underside of the elongated body 31 to guide the peg head 53 into the wide indentation 48. Additionally, a detachable face plate 41 may be attached to the downturned front portion 33.

Figure 8:
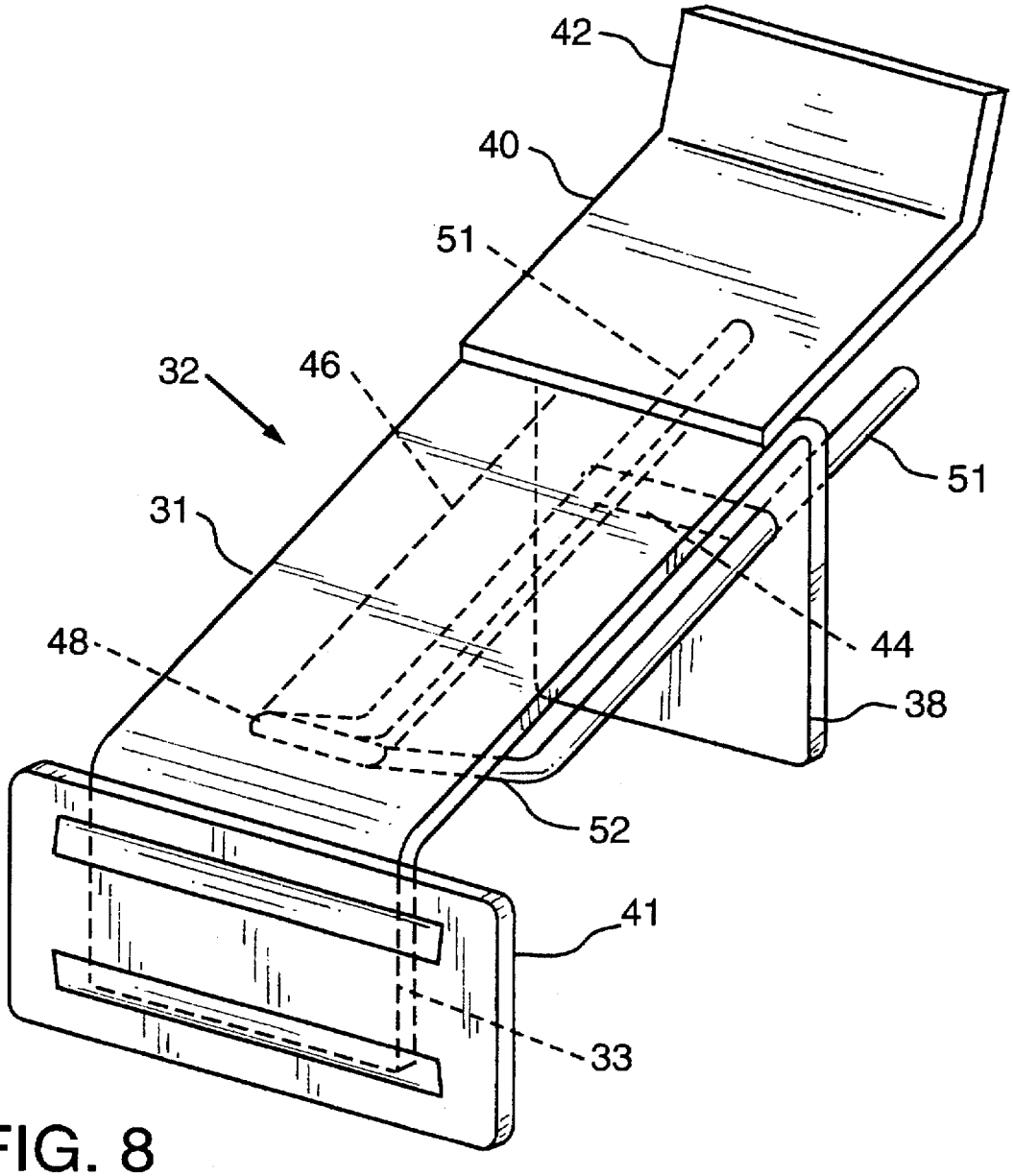
FIG. 8 is a perspective view of an alternative embodiment of a puller member.

FIG. 8 illustrates an alternative embodiment of the puller member 30 in FIG. 7. This puller member 32 can have the same wide elongated flat body 31, downturned front portion 33, and detachable face plate 41 as the puller member 30 in FIG. 7. In this embodiment however, the downward extending backstop 38 and the stabilizer 40 are not integrally formed. The stabilizer 40 can be a wide elongated flat member which is detachable from the rear of the wide elongated flat body 31. The stabilizer 40 can also have a slightly angled edge 42 to guide the stabilizer over a peg support member 25, shown in FIG. 14. A wide slot 44 can be provided in the backstop 38 for receiving a double-peg type housing 51.

Figure 9:
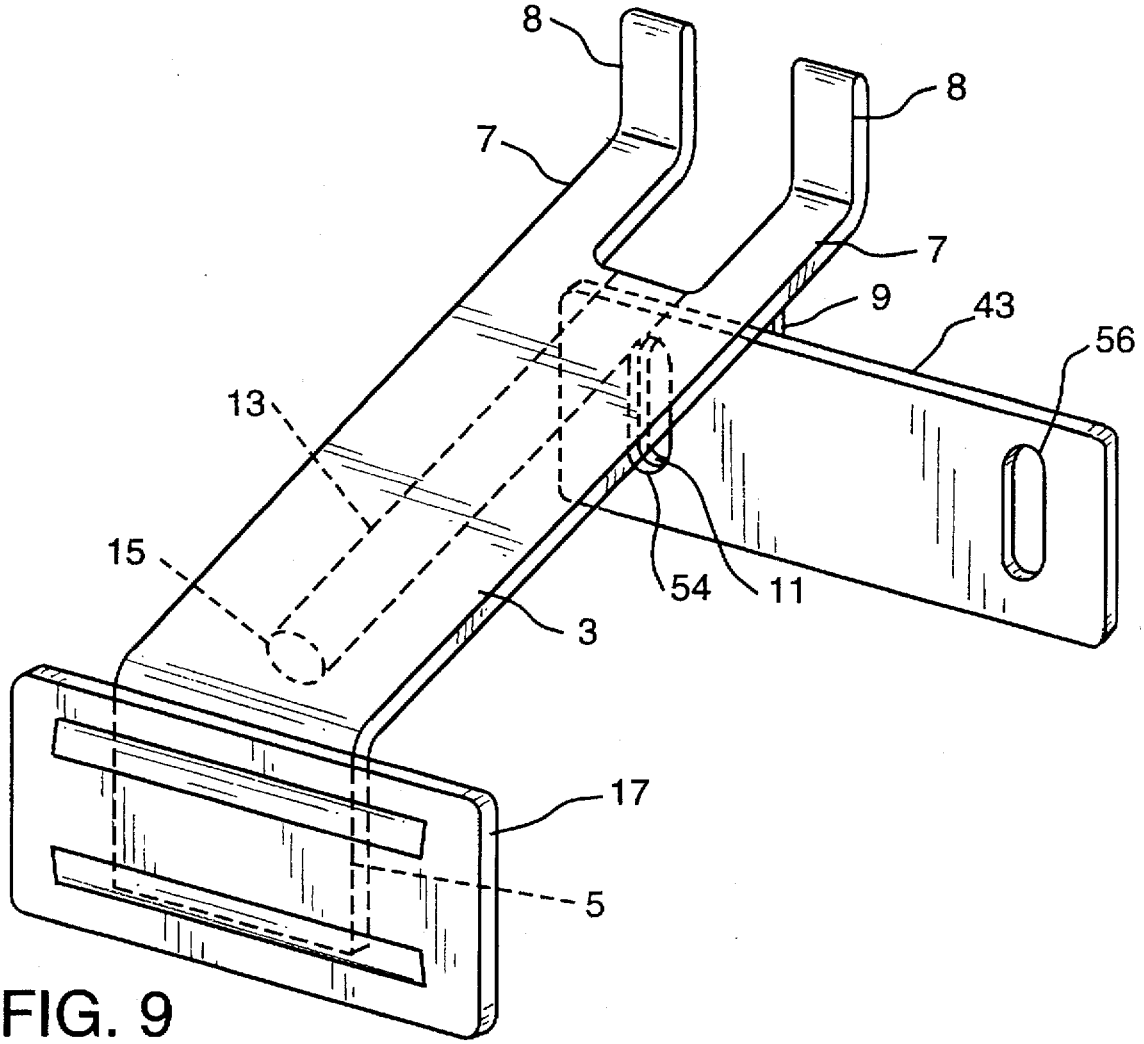
FIG. 9 is a perspective view of an embodiment of a single peg, two row puller member.
Figure 10:
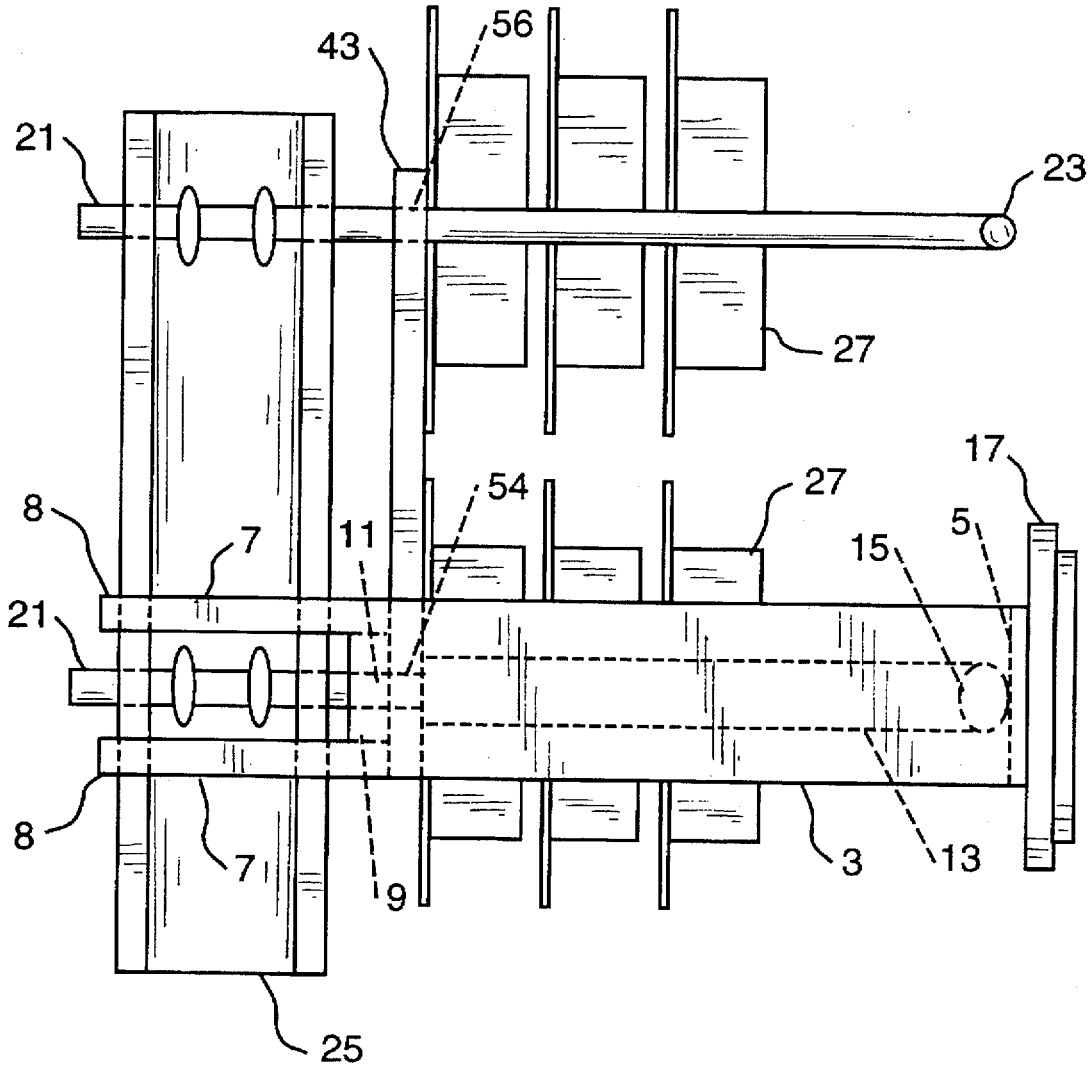
FIG. 10 is a top view of the puller member shown in FIG. 9.

In another embodiment shown in FIGS. 9 and 10, the elongated puller member 6 has the same preferably flat, elongated body 3 with downturned front portion 5, downward extending backstop 9 with stabilizer portions 7, and detachable face plate 17 as the puller member 1 shown in FIG. 1. The stabilizer portion 7 can also have slightly angled tail portions 8 to guide the stabilizer 10 over a peg support member. Additionally, the puller member 6 is provided with a free-floating wide backplate portion 43, identical to the free-floating backplate 90 except wider, disposed in front of the downward extending backstop portion 9. In this embodiment, the puller member 6 rests on a single peg 21, but is adapted to advance two rows of products 27 towards the front of two pegs 21 without actually needing to be inserted on both of the pegs 21. The wide backplate 43 has a first aperture 54 aligned with the aperture 11 in the backstop 9 and a second aperture 56 positioned to slidably receive an adjacent peg 21. The wide backplate 43 is detachable from the downward extending backstop 9 and is sized to engage an adjacent row of products 27 and to advance that row of products forward simultaneously with the row of products on the peg 21 on which the puller member 1 is disposed. Alternatively, the wide backplate 43 may be free floating on the pegs 21 between the backstop 9 and the products 27. When the puller member is drawn forwards the backstop 9 forces the free-floating wide backplate 43 forwards thereby advancing the products 27. Additionally, there may only be a extra wide single product, not shown, which is actually displayed on two adjacent pegs. The puller member 1 with the wide backplate 43 described above would operate in the same fashion just described. Additionally, the wide backplate 43 can be removably attached to the downward extending backstop instead of free floating.

Figure 11:
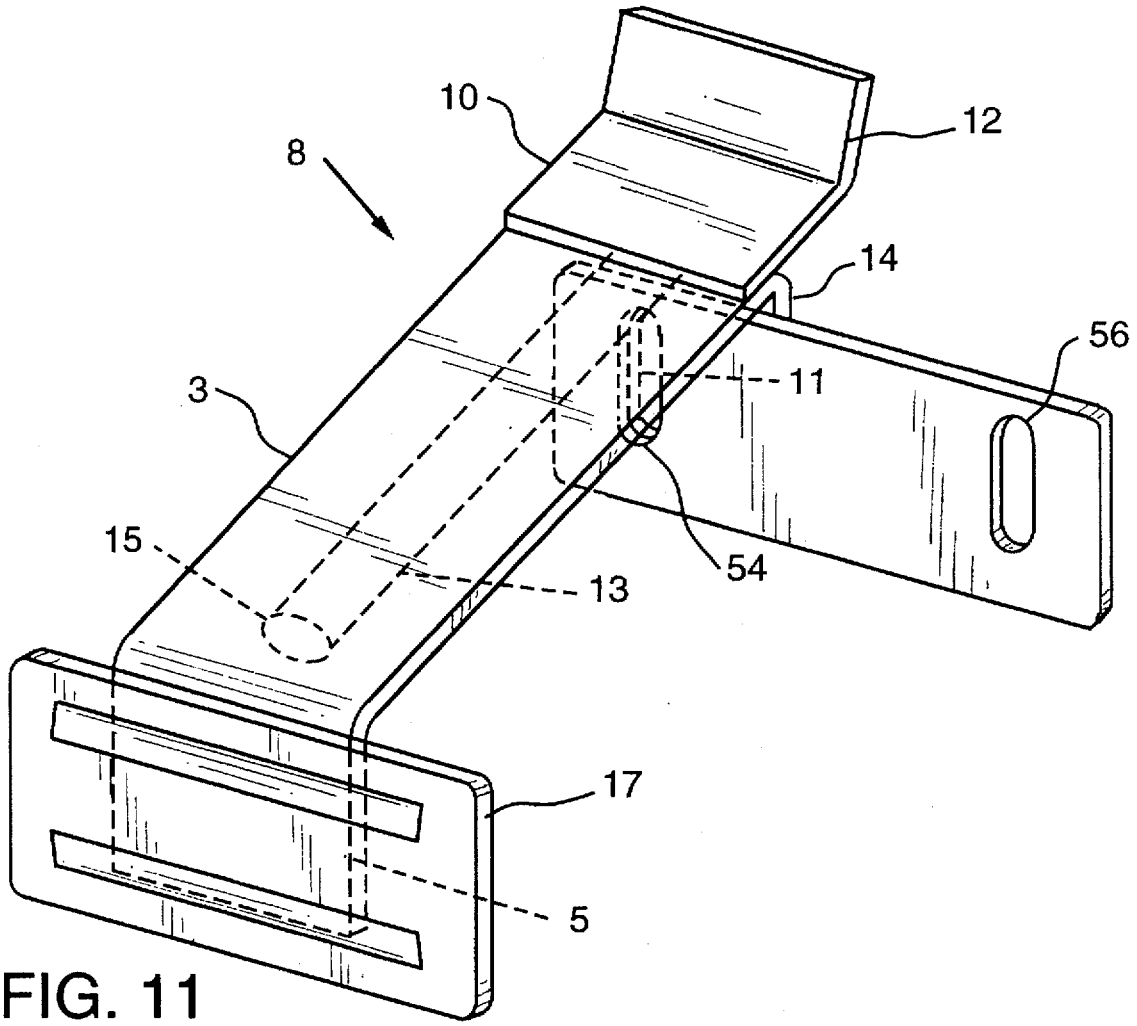
FIG. 11 is a perspective view of an alternative embodiment of a puller member.

In an alternative embodiment, shown in FIG. 11, the puller member 8 can be identical to the puller member 6 in FIG. 10 except it can have a detachable stabilizer 10 with a slightly angled edge 12 to guide the stabilizer 10 over a peg support member.

Figure 12:
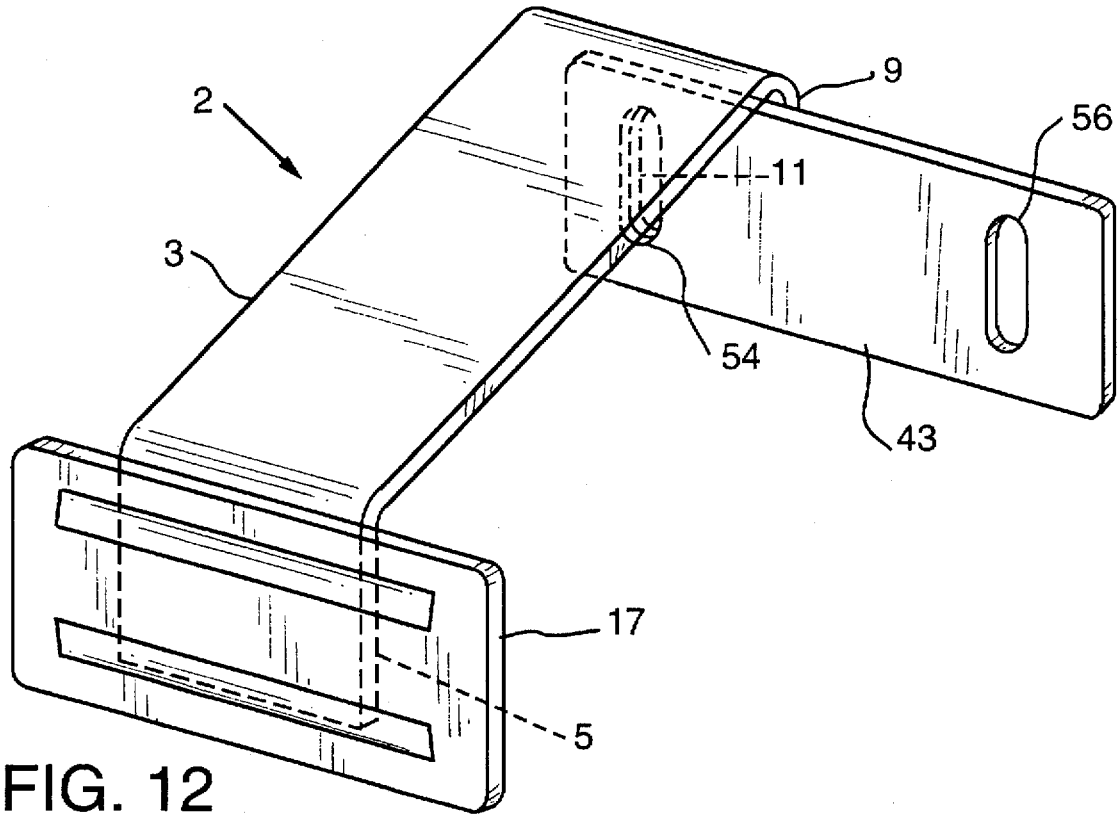
FIG. 12 is a perspective view of another alternative embodiment of a puller member.

In embodiments where a free floating wide backplate 43 is utilized, the elongated body of the rigid puller need not have an indentation, groove, or stabilizer since the puller member will ride on top of and be stabilized by the wide backplate 43. This is similar to puller members utilizing the free-floating backplate 90 described in FIG. 5 above. An alternative 3 embodiment of a puller member 2 provided with a free floating wide backplate 43 is illustrated in FIG. 12.

Figure 13:
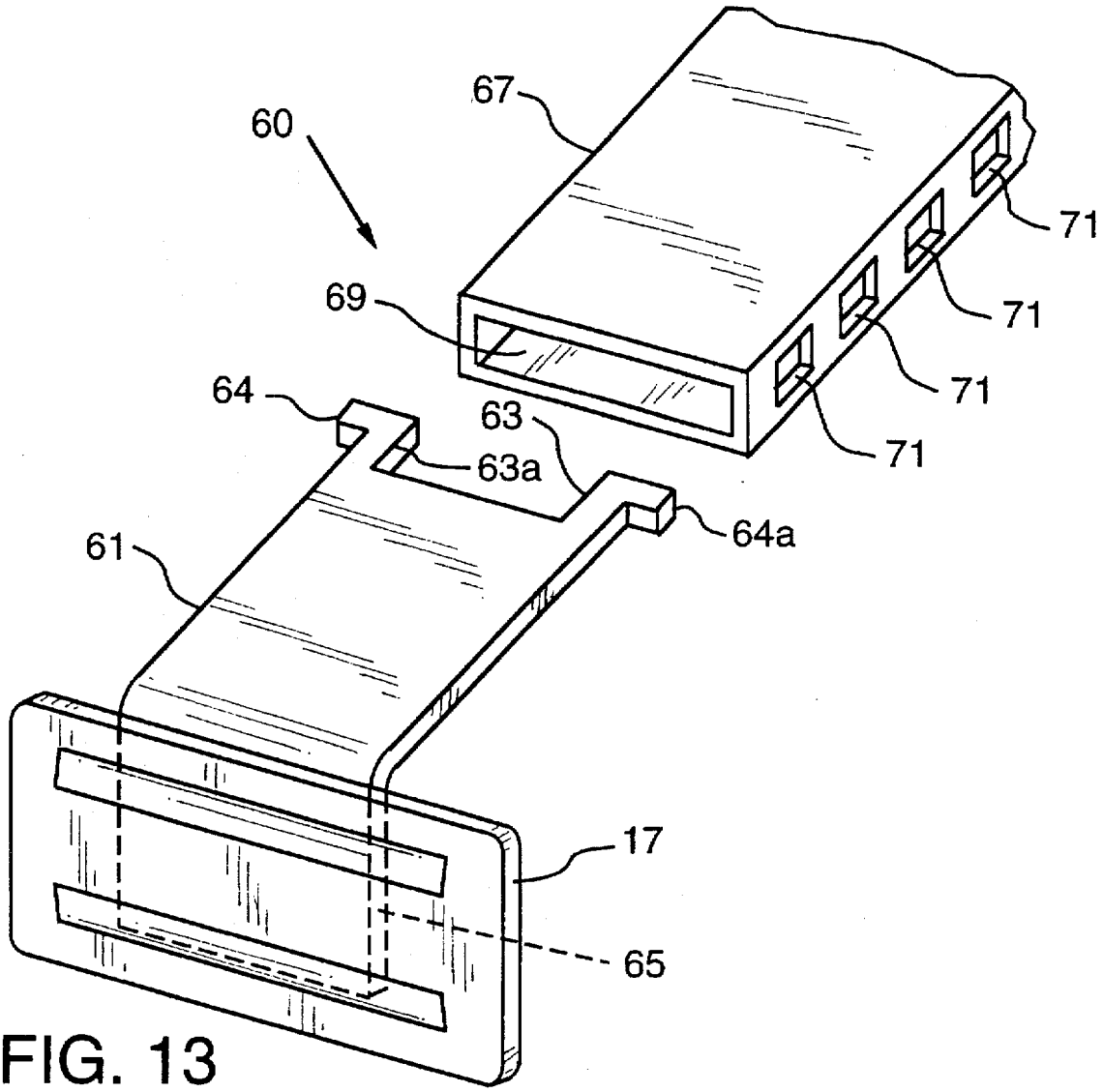
FIG. 13 is a perspective view of an embodiment of an adjustable length puller member.

In FIG. 13 an alternative embodiment of a puller member 60 having two slidably engaged parts is illustrated. Puller member 60 has a hollow housing 66 with a front opening 68 which is sized to receive a narrower, thinner front part 61. The hollow housing 66 has a pair of opposed side walls 67, 67*a* and a series of spaced apart openings 69 in each side wall 67, 67*a*. The front part 61 is sized to slide into the front opening 68 of the hollow housing 66 by squeezing together a pair of outwardly protruding tabs 64, 64*a*. A pair of resilient fingers 63, 63*a* extend from the back end of the front part 61. Tabs 64, 64*a* protrude outwardly and perpendicular to the fingers 63 and 63*a*. When the tabs 64, 64*a* are pressed together the front part 61 can be inserted into the front opening 68 of the hollow housing 66, and can also be adjusted therein. The front part 61 can be locked into place in the hollow housing 66 when the tabs 64, 64*a* are released and engage any of the series of spaced apart openings 69 in the hollow housing 66. In addition, the front part 61 can also have a downturned front portion 65 and a face plate 17. The back portion of the hollow housing 66 can be configured similarly to the other puller members previously described having downturned backstops and stabilizer member. In this manner, the puller member 60 can be adjusted to suit pegs of different lengths.

Figure 14:
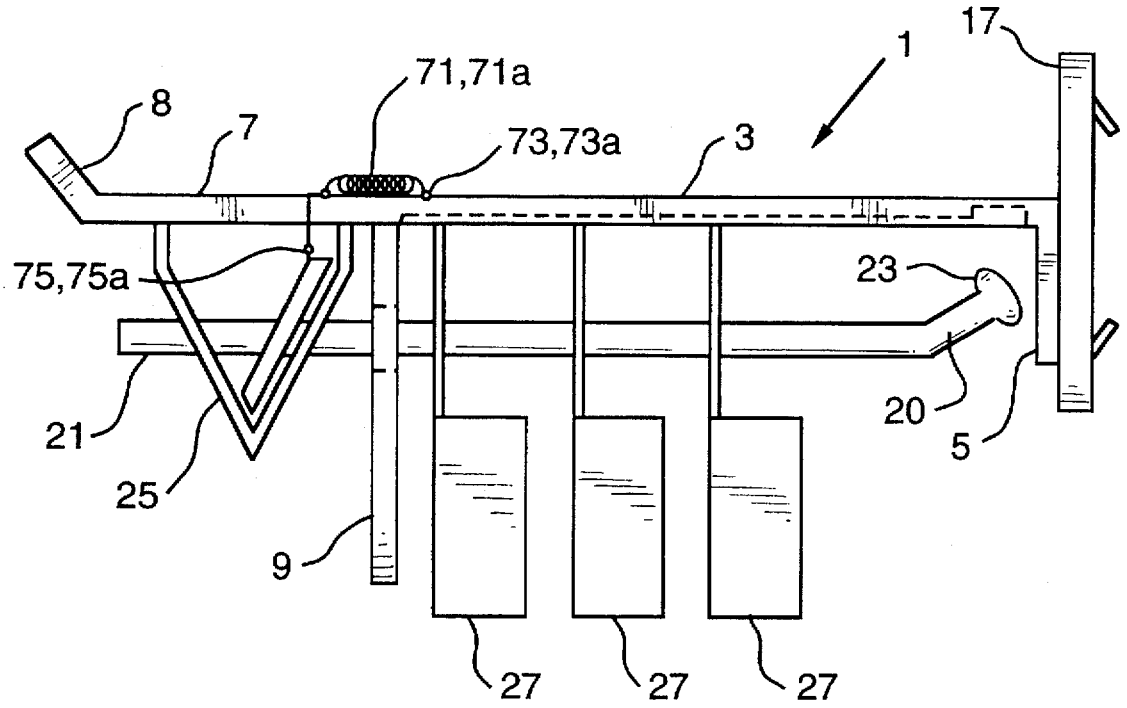
FIG. 14 is a side embodiment of a puller member having a return mechanism.
Figure 15:
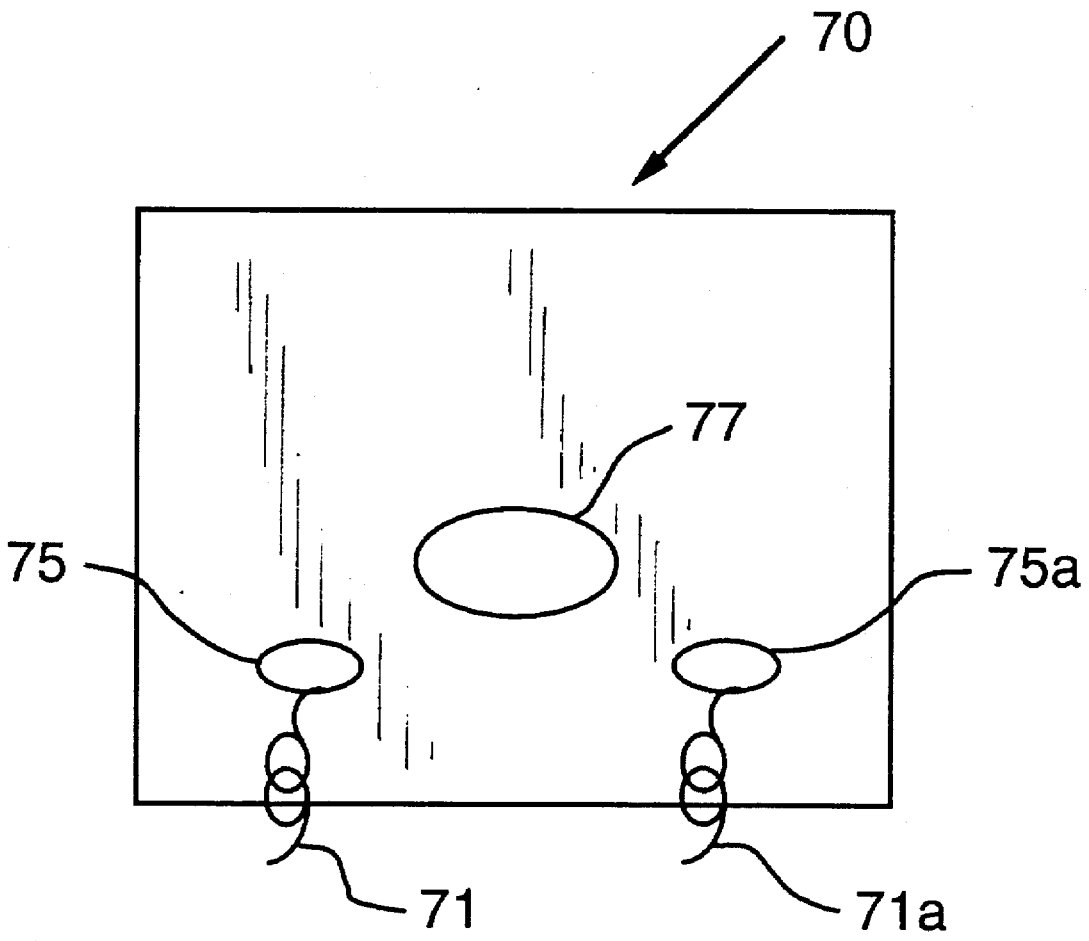
FIG. 15 is a front view of a retaining plate.

FIG. 14 illustrates a puller member 1 installed on a peg 21 and having a return mechanism connecting the puller member 1 and a retainer plate 70 which is disposed on the peg 21 and on the surface of a peg support 25. The return mechanism can include a pair of generally parallel springs 71, 71*a*. These springs 71, 71*a* are attached at one end to a pair of parallel attachment points on the stabilizer 70 or the rear portion of the elongated body 3. At the opposite end, the springs 71, 71*a* are attached at a pair of parallel attachment points 75, 75*a* on a retaining plate 70. The retaining plate 70 can additionally be provided with a hole 77, as shown in FIG. 15, through which the retaining plate 70 is inserted onto the peg 21. In this manner, when the puller member 1 is drawn forwards and then released, the return springs 71, 71*a* will retract the puller member back towards the back of the peg 21 and the peg support member 25.

Figure 16:
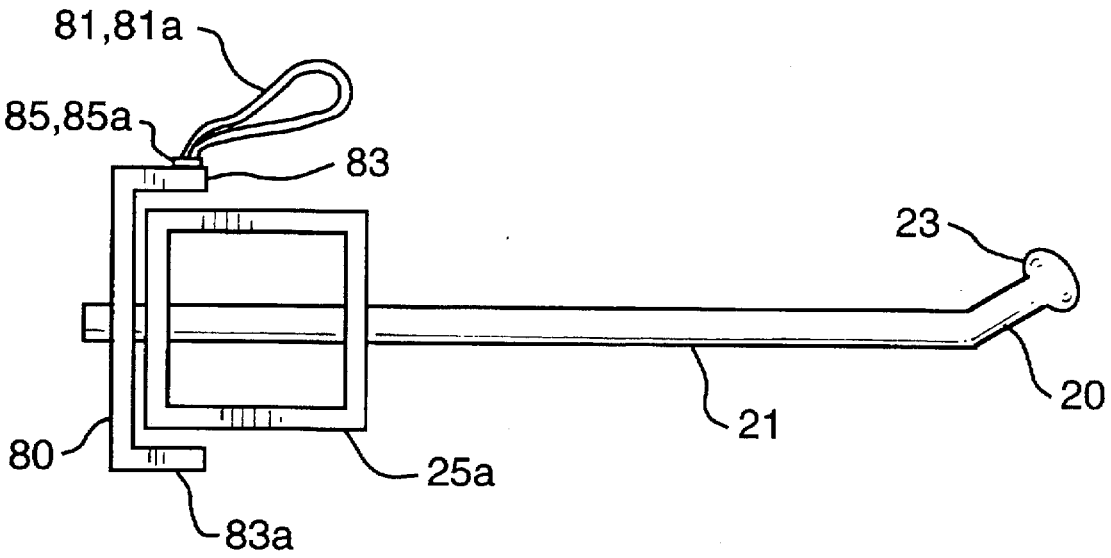
FIG. 16 is a side view of an alternative return mechanism.
Figure 17:
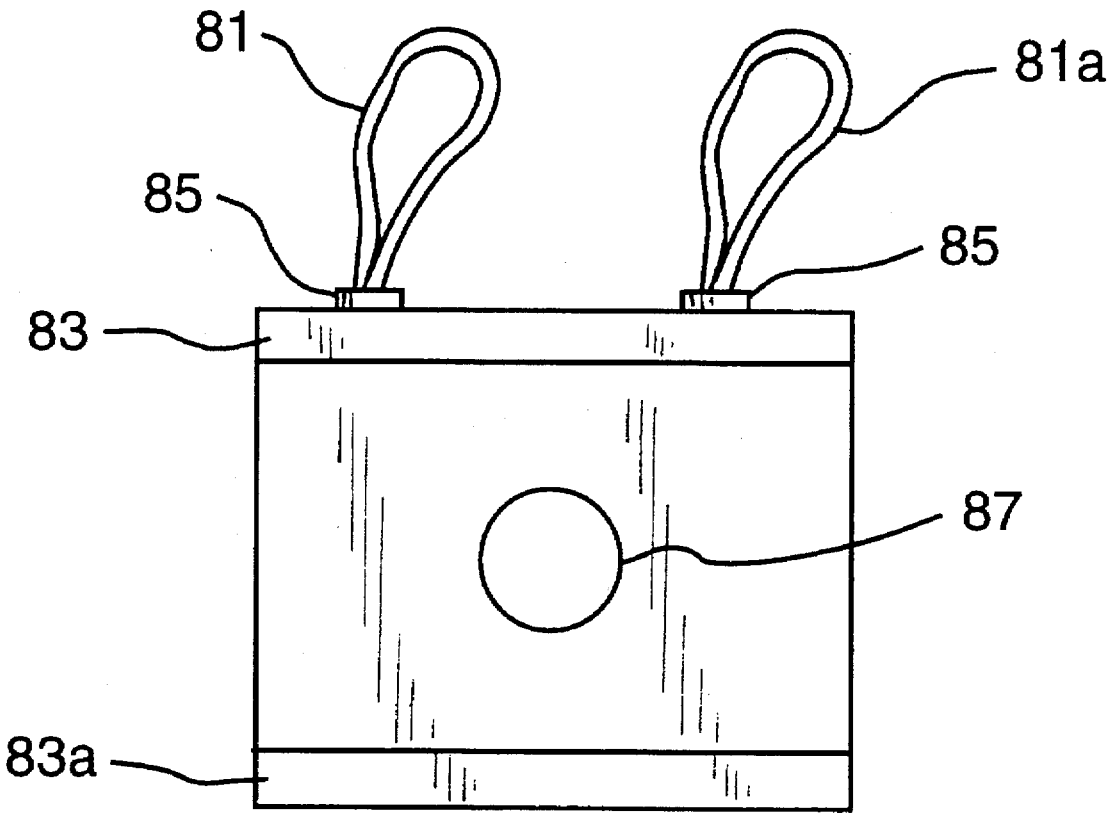
FIG. 17 is a front view of an alternative retaining plate.

FIGS. 16 and 17 illustrate a common square-shaped peg support member 25*a* and an alternative embodiment of a return mechanism. A retainer plate 80 is disposed on the peg 21 and on the surface of a peg support 25. The return mechanism can include a pair of rubber bands 81, 81*a*. These rubber bands 81, 81*a* are attached at one end to a pair of parallel attachment points on the stabilizer 7 or the rear portion of the elongated body 3, as shown in FIG. 14. At the opposite end, the rubber bands 81, 81*a* are attached at a pair of parallel attachment points 85, 85*a* on the retaining plate 80. The retaining plate 80 can additionally be provided with a hole 87, as shown in FIG. 17, through which the retaining plate 80 is inserted onto the peg 21. The retaining plate 80 is installed by sliding the upper arm 83 and lower arm 83*a* over the top and bottom sides of the square peg support member 25*a* with the peg 21 extending through the hole 87. When the puller member 1 is drawn forwards and then released, the rubber bands 81, 81*a* will retract the puller member 1 back towards the back of the peg 21 and the peg support member 25.

Although only embodiments of the puller member having a substantially flat elongated body have been illustrated, an elongated body which is V-shaped, half-circle shaped, or other various shapes, could also be satisfactorily employed. Furthermore, while specific embodiments have been illustrated and described in detail, it will be appreciated by those skilled in the art that various other modifications and alternatives to those details could be developed in light of the overall teachings of the disclosure. Accordingly, the particular embodiments disclosed herein are intended to be illustrative only and not limiting to the scope of the invention which should be awarded the full breadth of the following claims and any and all embodiments thereof.

I claim:

1. An apparatus for managing products displayed on pegs comprising:

a puller member movable relative to one of said pegs, said puller member having an elongated body slightly longer than one of said pegs;

said elongated body having a front gripping end and a rear downward extending backstop;

said backstop having an aperture therein for slidably receiving one of said pegs; and wherein said backstop advances products forwards when the puller member is drawn forwards and leaves the products undisturbed when the puller member is moved backwards.

2. The apparatus of claim 1 wherein said aperture is one of a hole and a slot.

3. The apparatus of claim 1 wherein said elongated body is substantially flat.

4. The apparatus of claim 3 wherein said gripping end comprises an integral downturned portion of said elongated body.

5. The apparatus of claim 4 further comprising a face plate removably attached to said downturned portion and said face plate being a gripping portion for pulling said puller member forwards.

6. The apparatus of claim 3 wherein said backstop comprises a integral downturned portion of said elongated body.

7. The apparatus of claim 3 further comprising:

said elongated body having an indentation on an underside thereof near to said gripping end;

said underside having a groove therein; and said groove having edges to guide a peg head into said indentation when all the products have been removed from the peg.

8. The apparatus of claim 7 wherein said indentation is slot shaped and transverse to said elongated body to receive a wide peg head of a double peg type hanger and said groove is sized wider than said indentation.

9. The apparatus of claim 1 wherein said of puller member further comprises:

a free-floating backplate having a first aperture therein coaxial with said aperture in said backstop;

said free-floating backplate disposed on said peg between said products and said backstop;

said free-floating backplate advancing a row of products when said backstop advances forward;

said free-floating backplate sized so that said elongated body rests on and is stabilized by said free-floating backplate; and said free-floating backplate remaining with said products when said puller member is pushed back.

10. The apparatus of claim 9 wherein said free-floating backplate is a free-floating wide backplate;

said wide backplate having a first aperture therein coaxial with said aperture in said backstop and sized to slidingly engage said peg;

said wide backplate also having a second aperture therein coaxial to and sized to slidingly receive a peg adjacent to the peg received in said first aperture; and said wide backplate sized to advance a row of products disposed on said peg received in said second aperture.

11. The apparatus of claim 10 wherein said wide backplate is removably attached to said backstop.

12. The apparatus of claim 11 wherein said aperture, said first aperture, and said second aperture are one of a hole and a slot.

13. The apparatus of claim 1 wherein said elongated body further comprises a rear stabilizer portion extending behind said backstop and resting on a peg support.

14. The apparatus of claim 13 wherein said rear stabilizer is removably attached to a top surface of said elongated body.

15. The apparatus of claim 13 wherein said elongated body is substantially flat.

16. The apparatus of claim 15 wherein said backstop and said rear stabilizer portion are integrally formed from said elongated body.

17. The apparatus of claim 16 wherein said backstop and said stabilizer portion are formed integrally from a rear portion of said substantially flat elongated body;

said rear portion having a two longitudinal cuts dividing said rear portion into left, right, and center sections;

said center section bent downwards to form said backstop;

said left and right sections forming said stabilizer; and said downward bent center section having said aperture therein to slidingly receive one of said pegs.

18. The apparatus of claim 1 wherein said elongated body further comprises at least two slidably engaged parts which are releasably latched at variable positions so that said elongated body is adjustable to accommodate pegs of different lengths.

19. The apparatus of claim 18 further comprising:

one of said at least two slidably engaged parts forming a hollow housing having a front opening, a pair of opposed side walls, and a plurality of spaced apart opening in said side walls;

another of said at least two slidably engaged parts forming a front part slidingly disposed in said hollow housing;

a pair of resilient fingers extending from opposite sides of a back end of said front part;

a pair of tabs on each of said pair of resilient fingers protruding outwardly through respective ones of said plurality of spaced apart openings thereby retaining said front part in said hollow housing; and wherein each of said pair of tabs is pressed inwardly and said resilient fingers flex inwardly so that each of said tabs no longer protrudes through respective ones of said plurality of spaced apart openings so that said front part may slide within said hollow housing until said resilient fingers cause each of said pair of tabs to protrude through other respective ones of said plurality of spaced apart openings.

20. The apparatus of claim 1 further comprising:

said puller member having a return mechanism attached at one end to one of a peg holder and a wall;

an opposite end of said return mechanism attached to said backstop; and wherein said return mechanism retracts said puller member when said puller member is pulled forwards and then released.

21. The apparatus of claim 20 wherein said return mechanism comprises:

a pair of retracting members positioned generally parallel to each other;

a retainer plate having a pair of generally parallel attachment points located at a top portion of said retainer plate and a peg hole in a central portion thereof;

said retainer plate disposed on a peg support member with a peg inserted through said peg hole;

said stabilizer portion having a pair of generally parallel attachment points located near a back edge thereof; and each of said pair of retracting members having a first end attached to said attachments points on said retainer plate and a second end attached to said attachments points on said stabilizer.

22. The apparatus of claim 21 wherein said pair of retracting members is one of a pair of springs and a pair of rubber bands.

23. An apparatus for managing products displayed on pegs comprising:

a puller member, said puller member having a substantially flat elongated body;

said elongated body being slightly longer than one of said pegs;

said elongated body having a front gripping end and a rear downward extending backstop;

a face plate removably attached to said front gripping end;

said backstop having an aperture therein for slidingly receiving on of said pegs;

a free-floating backplate disposed on said peg between said backstop and said products;

said free-floating backplate having a first aperture therein coaxial to said aperture in said backstop and sized to slidingly receive said peg;

said free-floating backplate sized so that said elongated body rests on and is stabilized by said free-floating backplate; and said free-floating backplate advancing products forwards when said puller member is drawn forwards and remaining behind said products when said puller member is moved backwards.

24. The apparatus of claim 23 wherein said free-floating backplate is a free-floating wide backplate;

said wide backplate having a first aperture therein coaxial with said aperture in said backstop and sized to slidingly engage said peg;

said wide backplate also having a second aperture therein coaxial to and sized to slidingly receive a peg adjacent to the peg received in said first aperture; and said wide backplate sized to advance a row of products disposed on said peg received in said second aperture.

25. The apparatus of claim 24 wherein each said aperture, said first aperture, and said second aperture are one of a slot and a hole.

* * * * *